US007609128B2

(12) United States Patent
Mizutani

(10) Patent No.: US 7,609,128 B2
(45) Date of Patent: Oct. 27, 2009

(54) SWITCH CIRCUIT

(75) Inventor: Hiroshi Mizutani, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 199 days.

(21) Appl. No.: 11/802,360

(22) Filed: May 22, 2007

(65) Prior Publication Data

US 2007/0273457 A1 Nov. 29, 2007

(30) Foreign Application Priority Data

May 23, 2006 (JP) ..... 2006-142732

(51) Int. Cl.
*H01P 1/15* (2006.01)
*H01P 5/18* (2006.01)

(52) U.S. Cl. ..... 333/103; 333/247

(58) Field of Classification Search ..... 333/101, 333/103, 104, 247, 262
See application file for complete search history.

(56) References Cited

U.S. PATENT DOCUMENTS 4,789,846 A * 12/1988 Matsunaga et al. ..... 333/104
5,485,130 A * 1/1996 Nakahara et al. ..... 333/104
5,856,713 A * 1/1999 Huettner et al. ..... 307/125
6,118,985 A * 9/2000 Kawakyu et al. ..... 455/78
6,980,057 B2 * 12/2005 Morimoto et al. ..... 330/286

FOREIGN PATENT DOCUMENTS

JP 2910681 4/1999
JP 3099880 8/2000

* cited by examiner

*Primary Examiner*—Dean O Takaoka
(74) *Attorney, Agent, or Firm*—McGinn IP Law Group, PLLC

(57) ABSTRACT

A branch path having a transmission line and a distributed constant line includes a resonant circuit. The resonant circuit resonates at a predetermined operating frequency when the branch path is in OFF state. At this time, the distributed constant line has a predetermined impedance. Further, an impedance of a node between the resonant circuit and distributed constant line can be set on a circle of a reflection coefficient 1 near short on the Smith chart.

18 Claims, 7 Drawing Sheets

TRANSISTOR STATE

| | PERIOD A | PERIOD B |
|---|---|---|
| OUTPUT | P1 | P2 |
| OFF SIDE BRANCH | BRANCH PATH 3 | BRANCH PATH 2 |
| DISTRIBUTED CONSTANT LINE 7 | **ON** | OFF |
| Tr2 | **OFF** | ON |
| DISTRIBUTED CONSTANT LINE 5 | OFF | **ON** |
| Tr1 | ON | **OFF** |

Fig. 4

DIODE STATE

| | PERIOD A | PERIOD B |
|---|---|---|
| OUTPUT | P2 | P1 |
| OFF SIDE BRANCH | BRANCH PATH 2 | BRANCH PATH 3 |
| DISTRIBUTED CONSTANT LINE 70 | REVERSE BIAS | **FORWARD BIAS** |
| D2 | FORWARD BIAS | **REVERSE BIAS** |
| DISTRIBUTED CONSTANT LINE 50 | **FORWARD BIAS** | REVERSE BIAS |
| D1 | **REVERSE BIAS** | FORWARD BIAS |

SWITCH CIRCUIT

BACKGROUND OF THE INVENTION

1. Field of the Invention

The present invention relates to a switch circuit having a plurality of branch paths.

2. Description of Related Art

As a preferable characteristic of a switch circuit (SPnT type switch circuit etc.) used for microwave/millimeter wave bands, low insertion loss characteristics and high isolation characteristics are desired, for example.

In order to satisfy these characteristics especially when an operating frequency is wide band, there is known a switch circuit (traveling wave type switch) that utilizes a distributed transmission line including a field effect transistor (FET) structure (see Japanese Patent Publications No. 2910681 and No. 3099880).

By using this traveling wave type switch, a favorable switching characteristic can be achieved in wide band. However, even when favorably configuring a traveling type switch SPDT switch using a distributed constant line having FET structure of the length of a gate electrode being 400 μm, an insertion loss is approximately 2.1 dB and an isolation characteristic is approximately 30 dB at 76 GHz. That is, it is hard to achieve enough characteristics in a millimeter wave band (approx. 30 GHz to 300 GHz).

This is because, in the distributed constant line of the traveling wave type switch, resistance value increases along with the increase of the frequency, thus seeing a branch path in OFF state from a diverging point via a transmission line, impedance cannot be shown completely open. The loss generated in the branch path in OFF state is a trouble in improving the characteristics of a switch circuit. Specifically in a conventional switch circuit, it has now been discovered that low enough loss characteristics and high enough isolation characteristic may not be achieved in a predetermined frequency band.

SUMMARY

According to an aspect of the present invention, there is provided a switch circuit comprising: a first branch path provided between an input terminal and a first output terminal and including a first transmission line and a first distributed constant line; a second branch path provided between the input terminal and a second output terminal and including a second transmission line and a second distributed constant line; a first resonant circuit connected between the first transmission line and the first distributed constant line to resonate at a predetermined frequency while the first branch path is in OFF state; and a second resonant circuit connected between the second transmission line and the second distributed constant line to resonate at a predetermined frequency while the second branch path is in OFF state.

With this configuration, in the branch path in OFF state, the resonant circuit resonates at a predetermined operating frequency and at the same time, the distributed constant line has a predetermined impedance. At this time, an impedance of a node between the resonant circuit and the distributed constant line can be set on a circle of a reflection coefficient 1 near short on the Smith chart. By configuring as above, the branch path in OFF state can be seen as open from a diverging point via the length of the transmission line. Thus the characteristics for the switch circuit can be improved.

According to an aspect of the present invention, there is provided a switch circuit comprising: a plurality of branch paths, each of the branch paths is provided between an input terminal and an output terminal and includes a transmission line and a distributed constant line; a plurality of resonant circuits, each of the resonant circuits is connected between the transmission line and the distributed constant line, and resonates at a predetermined frequency while the branch path, to which the resonant circuit is connected, is in OFF state.

According to an aspect of the present invention, there is provided a switch circuit comprising: an input terminal; a first output terminal; a second output terminal; a first branch path provided between the input terminal and the first output terminal and including a first transmission line and a first distributed constant line; a second branch path provided between the input terminal and the second output terminal and including a second transmission line and a second distributed constant line; a first resonant circuit connected between the first transmission line and the first distributed constant line to resonate at a predetermined frequency while the first branch path is in OFF state; and a second resonant circuit connected between the second transmission line and the second distributed constant line to resonate at a predetermined frequency while the second branch path is in OFF state.

According to the switch circuit of the present invention, characteristics for the switch circuit can be improved in a predetermined operating frequency.

BRIEF DESCRIPTION OF THE DRAWINGS

The above and other objects, advantages and features of the present invention will be more apparent from the following description of certain preferred embodiments taken in conjunction with the accompanying drawings, in which:

FIG. 4 is a table explaining the state of a distributed constant line or the like according to the control signals;

DETAILED DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposes.

First Embodiment

Figure 1:
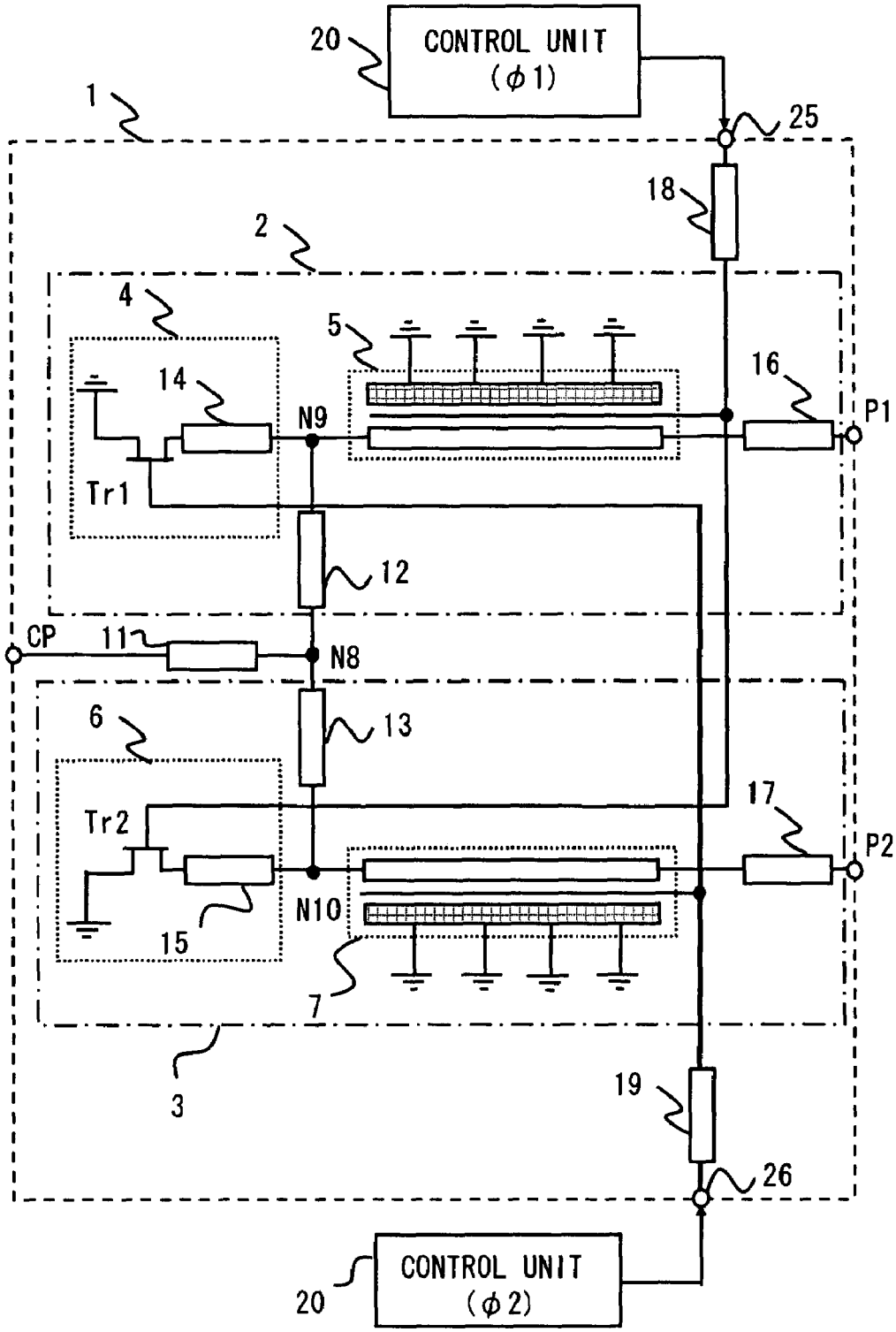
FIG. 1 is a schematic diagram showing an overall configuration of a switch circuit according to a first embodiment of the present invention.

FIG. 1 is a configuration diagram showing an overall switch circuit according to an embodiment of the present invention.

As shown in FIG. 1, a switch circuit 1 is a SPDT (Single Pole Double-Throw) type switch circuit. The switch circuit 1 includes a common input terminal CP and two output terminals (first output terminal P1 and second output terminal P2).

A signal input from the input terminal CP according to a control signal from a control unit 20 is transmitted to either of the output terminal P1 or output terminal P2. Note that the switch circuit 1 is formed over a GaAs substrate having approximately 40 μm thickness.

The switch circuit 1 includes a branch path 2 (first branch path) and branch path 3 (second branch path). The branch path 2 and branch path 3 are connected in parallel to a node N8 (diverging point). By making either of the branch path 2 or branch path 3 to be in OFF state and another to be in ON state, an input signal from the input terminal CP is transmitted to the branch path in ON state and not transmitted to the branch path in OFF state. An output signal is output from the output terminal P1 or P2 through the branch path in ON state.

The branch path 2 includes a distributed constant line 5. The distributed constant line 5 controls ON or OFF state of the branch paths. The distributed constant line 5 is a transmission line having field effect transistor (FET) structure (detailed structure described later in detail). One end of a drain electrode of the distributed constant line 5 is connected to the node N8 via a transmission line 12. Another end of the drain electrode is connected to the output terminal P1 via a transmission line 16. A source electrode is fixed to a ground potential. A gate terminal (control terminal) is connected to the control unit 20 via an isolation line 18. The distributed constant line 5 becomes. ON or OFF state according to a control signal supplied from the control unit 20 to the gate terminal.

In this embodiment, a resonant circuit 4 is connected to a node N9 in the branch path 2 in parallel to the distributed constant line 5. To make the branch path 2 in OFF state, the resonant circuit 4 resonates in a predetermined operating frequency (76 GHz in this example) using an N type FET Tr1 in OFF state as a capacitor C and a transmission line 14 as an inductor L. It should be noted that as the capacitance of the resonant circuit 4, a FET is used. Specifically, by controlling a gate voltage of the FET according to the control signal (ϕ2) from the control unit 20, Tr1 is turned OFF state to temporarily function as a capacitor. That is, the resonant circuit can be controlled to be in ON or OFF state according to the switching between the output terminals P1 and P2.

The configuration on the side of the branch path 3 viewed from the node N8 is almost same as the abovementioned configuration on the side of the branch path 2. To be more specific, a distributed constant line 7 corresponds to the distributed constant line 5, a resonant circuit 6 corresponds to the resonant circuit 4, a transistor Tr2 corresponds to the transistor Tr1, a transmission line 15 corresponds to the transmission line 14, a transmission line 17 corresponds to the transmission line 16 and an isolation line 19 corresponds to the isolation line 18. A transmission line 11 is provided between the input terminal CP and node N8 to match impedance.

Figure 2:
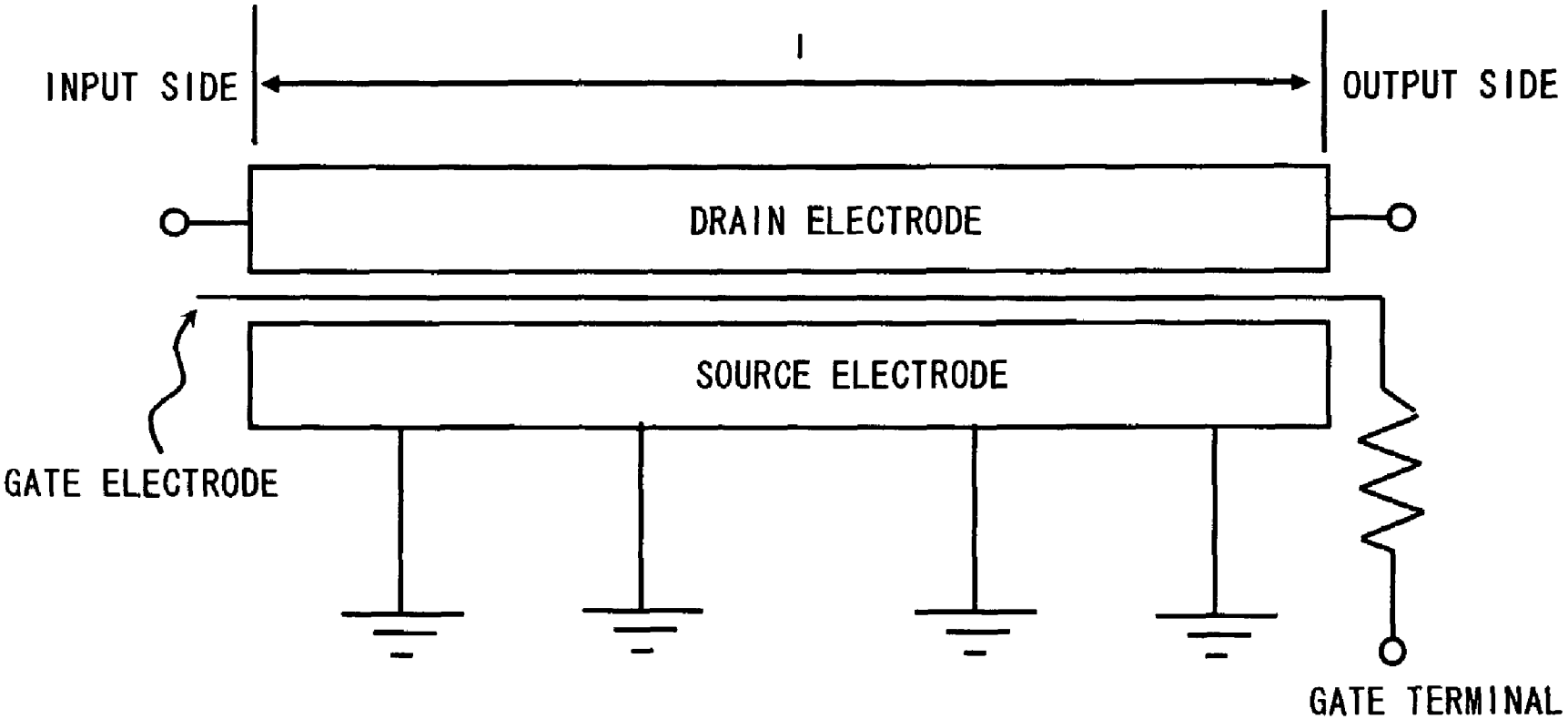
FIG. 2 is a schematic diagram explaining the structure of a distributed constant line having FET structure.

FIG. 2 is a view showing a schematic structure of the distributed constant line 5. As shown in FIG. 2, the distributed constant line 5 has FET structure. The distributed constant line includes a source and drain electrode placed at each side of a gate electrode. An end of the drain electrode forms an input end and another end forms an output end. The source electrode is connected to ground. The length of the gate electrode (gate finger length) is set to more or equal to 1/16 of a propagated wavelength corresponding to the operating frequency.

When the distributed constant line 5 is in ON state, a channel between the source and drain region of the FET structure is cut off (in OFF state) and a shunt conductance G is 0S. Accordingly the distributed constant line 5 operates in an equivalent circuit same as a transmission line with almost no loss, achieving a low insertion loss characteristics in wide band. On the other hand, when the distributed constant line 5 is in OFF state, the channel between the source and drain regions of the FET structure is formed (in ON state) and a loss is generated due to the shunt conductance G. Because of the increase in the impedance by series inductance, an isolation characteristic of the switch circuit 1 increases.

A mechanism in which the control unit 20 controls the switch circuit 1 is described hereinafter in detail. The control unit 20 outputs a control signal (ϕ1) input to the switch circuit 1 via an external terminal 25, and outputs a control signal (ϕ2) input to the switch circuit 1 via an external terminal 26.

A gate electrode of the distributed constant line 5 and a gate electrode of Tr2 are connected to the external terminal 25. A gate electrode of the distributed constant line 7 and Tr1 are connected to the external terminal 26.

Figure 3:
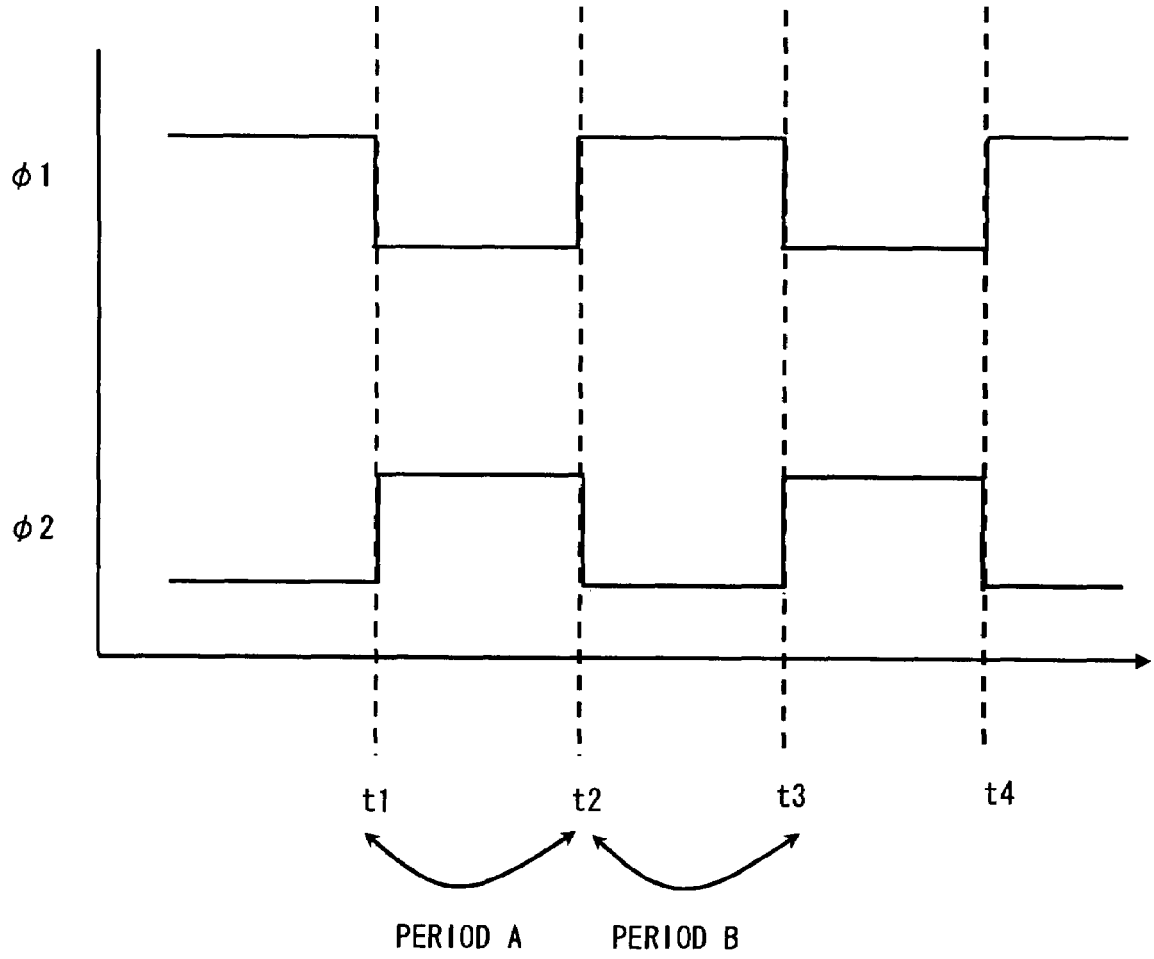
FIG. 3 is a chart explaining control signals (ϕ1 and ϕ2) supplied from a control unit.

As shown in FIG. 3, the control signals ϕ1 and ϕ2 are in reversed phase to each other.

With reference to FIG. 3 and FIG. 4, branch path in OFF state is described hereinafter in detail. As shown in FIG. 3 and FIG. 4), in the period A, a signal is transmitted from the input terminal CP to output terminal P1. At this time, on the side of the branch path 3 in OFF state, the distributed constant line 7 is in ON state and Tr2 is in OFF state. When the distributed constant line 7 is in ON state, a loss caused by the shunt conductance G is generated. When Tr2 is in OFF state, Tr2 functions as a capacitor. Further, the resonant circuit 6 series-resonates at an operation frequency of 76 GHz according to inductor and capacitor of the transmission line 15.

As described in the foregoing, in the branch path 3 in OFF state, the resonant circuit 6 resonates at a predetermined operating frequency (76 GHz) and the distributed constant line 7 has a predetermined impedance. Further, the branch path 2 in ON state operates complementary to the branch path 3 in OFF state. At this time, the impedance of a node N10 can be set on a circle of reflection coefficient 1 near short on the Smith chart. By setting in this way, the branch path 3 in OFF state is seen as open at the node N8 via the length of the transmission line 13. Therefore, the characteristics of the switch circuit at a predetermined operating frequency can be improved.

In the period B (see FIG. 3) of FIG. 4, a signal is transmitted from the input terminal CP to output terminal P2. In this case, the distributed constant line 5 corresponds to the distributed constant line 7, Tr1 corresponds to Tr2, transmission line 12 corresponds to transmission line 13 and node N9 corresponds to node N10.

Incidentally, in the abovementioned case, the lengths of the transmission lines 12 and 13 are set to approximately λ/4, provided that a propagated wavelength corresponding to an operation frequency is λ.

By an evaluation over the characteristics of the switch circuit 1 under this condition, it is found that an insertion loss can be reduced to approx. 1.3 dB at an operation frequency of 76 GHz band (which is approx. 2.1 dB in a conventional technique). Further, an isolation characteristic of more than 100 dB can be obtained (which is approximately 30 dB in a conventional technique).

Components included in the switch circuit 1 can be configured as follows for example. Note that each transmission line in this embodiment is constituted by microstrip line. The transmission lines 12 and 13 have lengths of 290 μm and widths of 120 μm. The distributed constant lines 5 and 7 have gate finger lengths of 400 μm. The transmission lines 14 and 15 have lengths of 115.7 μm and widths of 10 μm. Gate widths of Tr1 and Tr2 are 100 μm. The transmission line 11 has a length of 60 μm and width of 120 μm. The transmission lines 16 and 17 have lengths of 310 μm and widths of 120 μm.

Second Embodiment

Figure 5:
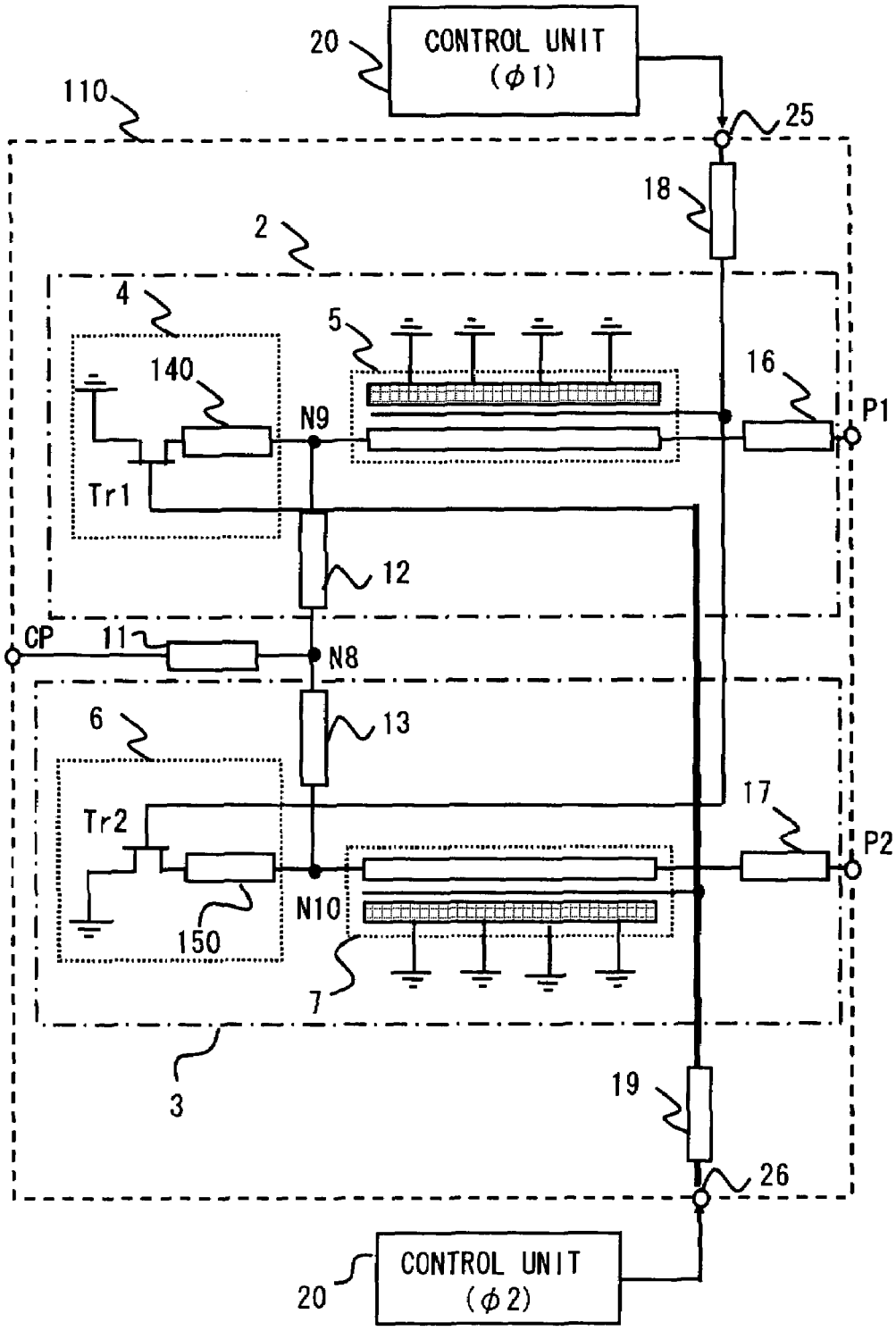
FIG. 5 is a schematic diagram showing an overall configuration of a switch circuit according to a second embodiment of the present invention.

A second embodiment of the present invention is described hereinafter in detail with reference to FIG. 5. In the following descriptions, like parts are marked same number, and repeated explanations are omitted.

A difference from the first embodiment is that winding inductors 140 and 150 are employed instead of the transmission lines 14 and 15. The winding inductor 140 (winding inductor 150) enables to deal with a case in which a value of inductor of the transmission line is not enough. Specifically in a low operating frequency, inductor included in the transmission line 14 is sometimes not enough in low operating frequency band. To compensate this, winding inductors that are able to obtain enough inductor value are employed. In this example, winding inductors of 145 pH are employed at an operating frequency of 38 GHz.

The components included in the switch circuit 100 can be configured as follows for example. Note that each transmission line in this embodiment is constituted by microstrip line. The transmission lines 12 and 13 have lengths of 665 μm and widths of 50 μm. The distributed constant lines 6 and 7 have gate finger lengths of 400 μm. The winding inductors 140 and 150 are 145 pH. Gate width of Tr1 and Tr2 are 100 μm. The transmission line 11 has a length of 60 μm and width of 30 μm. The transmission lines 16 and 17 have lengths of 450 μm and widths of 120 μm.

Third Embodiment

Figure 6:
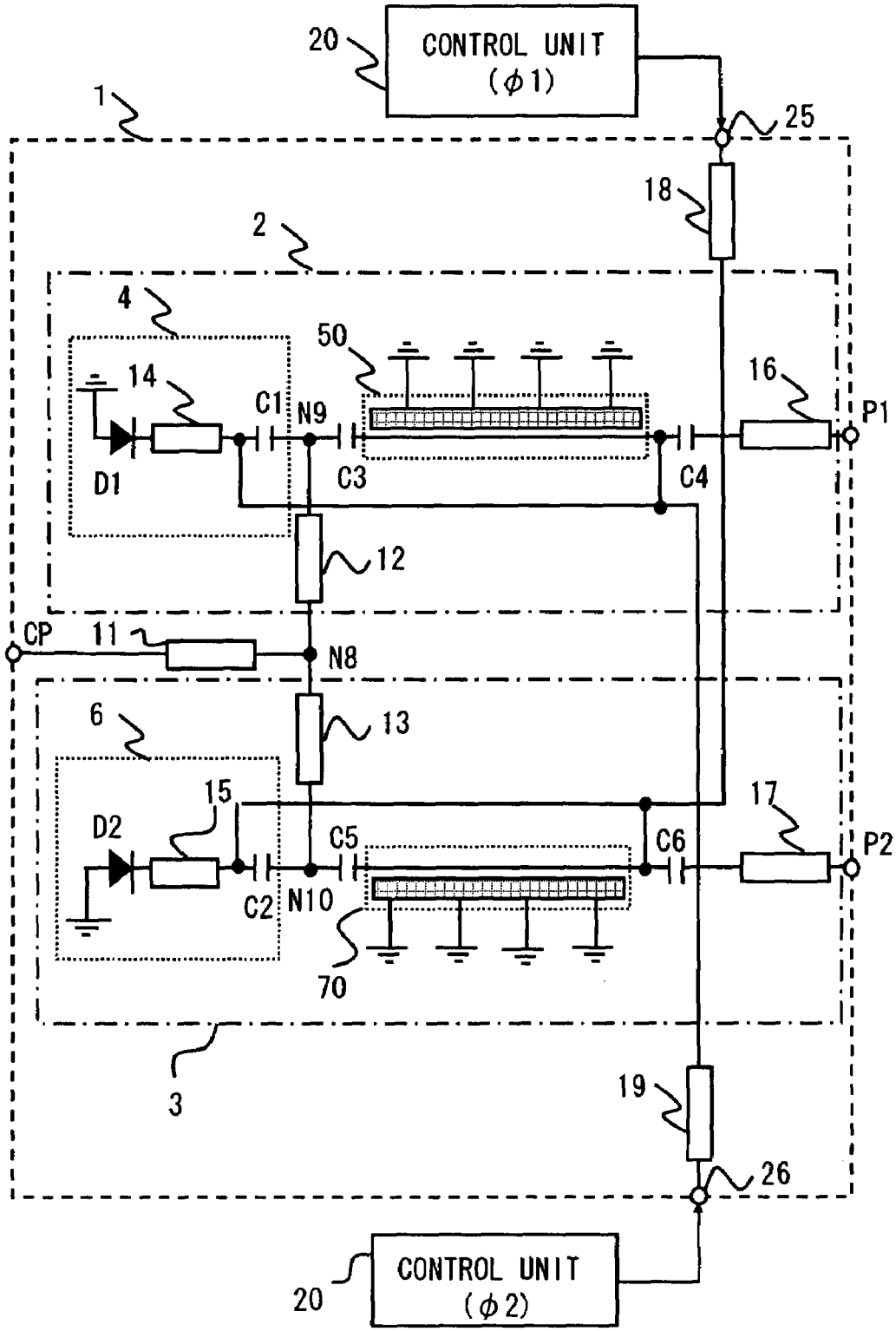
FIG. 6 is a schematic diagram showing an overall configuration of a switch circuit according to a third embodiment of the present invention.

A third embodiment of the present invention is described hereinafter in detail with reference to FIGS. 6, 7 and 8. In the following descriptions, like parts are marked same number, and repeated explanations are omitted.

Differences are that distributed constant lines 50 and 70 having diode structure are employed instead of the distributed constant lines 5 and 7 having FET structure, and diodes D1 and D2 are employed instead of field effect transistors Tr1 and Tr2. Further as shown in FIG. 6, a connection path for a control signal input from the control unit 20 to each of the branch paths is also modified.

The distributed constant line 50 controls ON or OFF state of the branch path 2. The distributed constant line 50 has a diode structure. The diode structure included in the distributed constant line 50 is a schottky diode structure having a substrate and wiring region as shown in FIG. 7. In this embodiment, the substrate region is formed by an ohmic electrode and the wiring region is formed by a schottky electrode. Further, capacitors C3 and C4 for DC-cut are provided at both ends of the distributed constant line 50. Further, the control signal (ϕ2) is input between the capacitors C3 and C4 from the control unit 20 via the isolation line 19. ON or OFF state of the distributed constant line 50 is determined according to the control signal (ϕ2). Note that in this embodiment, when the distributed constant line 50 is in ON state, the diode structure included in the distributed constant line 50 is in the reverse bias state. On the other hand, when the distributed constant line 50 is in OFF state, the diode structure included in the distributed constant line 50 is in the forward bias state.

The resonant circuit 4 includes a diode D1, transmission line 14 and capacitor C1. The diode D1 is a schottky diode with a substrate region connected to ground and a wiring region connected to one end of the transmission line 14. Note that another end of the transmission line 14 is connected to the capacitor C1 for DC-cut. One end of the capacitor C1 is connected to the transmission line 14 and another end is connected the node N9. Further, a control signal (ϕ2) is input between the transmission line 14 and capacitor C1 from the control unit 20 via the isolation line 19. The resonant circuit 4 becomes ON or OFF state according to the control signal (ϕ2). In this embodiment, when the branch path 2 is in ON state, the diode D1 is in the forward bias state. On the other hand, when the branch path 2 is in OFF state, the diode D1 is in the reverse bias state.

Note that the configuration of the distributed constant line 70 corresponds to the distributed constant line 50 and the configuration of the resonant circuit 6 corresponds to the resonant circuit 4. The capacitors C5 and C6 correspond to capacitors C3 and C4.

A branch path in OFF state is described hereinafter in detail with reference to FIG. 8. In the period A (see FIG. 3) of FIG. 8, a signal is transmitted from the input terminal CP to output terminal P2. At this time, the branch path 2 is in OFF state, the diode structure included in the distributed constant path 50 is in the forward bias state while the diode D1 included in the resonant circuit 4 is in the reverse bias state. When the distributed constant line 50 is in OFF state, a loss caused by the shunt conductance G is generated. When the diode D1 is in the reverse bias state, D1 functions as a capacitor. Further the resonant circuit 4 series-resonates at a predetermined operating frequency (76 GHz) that is determined from a value of inductance of the transmission line 14 and a value of capacitance of the diode D1.

As described in the foregoing, in the branch path 2 in OFF state, the resonant circuit 4 resonates at a predetermined operating frequency (76 GHz) and the distributed constant line 50 has predetermined impedance. Further, the branch path 3 in ON state operates complementary to the branch path 2 in OFF state. At this time, the impedance of the node 9 can be set on a circle of the Smith chart. By setting in this way, the branch path 2 in OFF state is seen as open at the node N8 via the length of the transmission line 12. Therefore, the characteristics of the switch circuit at a predetermined operating frequency can be improved.

Figures 7, 8:
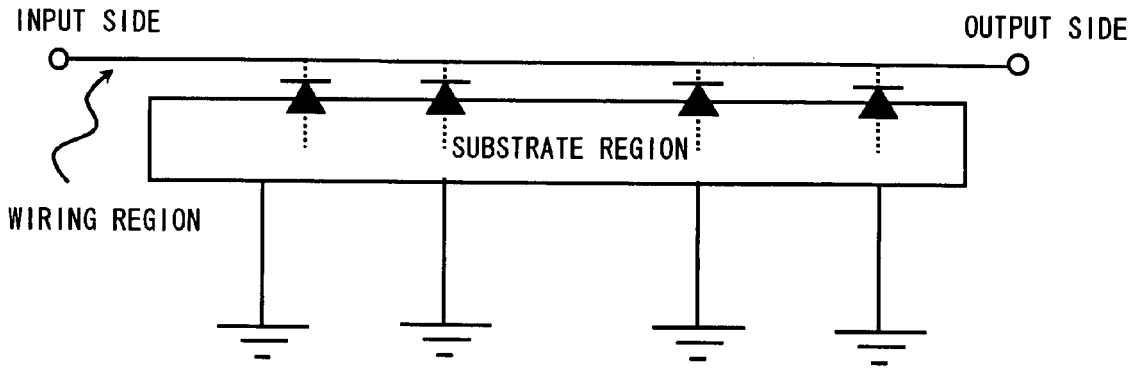
FIG. 7 is a schematic diagram explaining the configuration of distributed constant line having diode structure.
FIG. 8 is a table explaining the state of the distributed constant line or the like according to the control signals.

In the period B (see FIG. 3) of FIG. 8, a signal is transmitted from the input terminal CP to output terminal P1. In this case, the distributed constant line 70 corresponds to the distributed constant line 50, diode D2 corresponds to diode D1, transmission line 13 corresponds to transmission line 13 and node N10 corresponds to node N9.

The present invention is not limited to the above embodiments and it may be modified and changed without departing from the scope and spirit of the invention. The node N8 may be provided to each of the branch paths. Further, the number of branch paths may be any number. The diode may be configured in an opposite direction to the direction described in this embodiment. In such case, the control method of the diode is appropriately modified.

The structure of the transmission line may be coplanar waveguide. Note that if the transmission line is a coplanar waveguide, by connecting ground lines each other that are placed on both sides of a FET or diode, and a ground potential can be stabled.

It is apparent that the present invention is not limited to the above embodiments, but may be modified and changed without departing from the scope and spirit of the invention.

What is claimed is:

1. A switch circuit, comprising:

a first branch path provided between an input terminal and a first output terminal and including a first transmission line and a first distributed constant line;

a second branch path provided between the input terminal and a second output terminal and including a second transmission line and a second distributed constant line;

a first resonant circuit connected between the first transmission line and the first distributed constant line to resonate at a predetermined frequency while the first branch path is in OFF state; and a second resonant circuit connected between the second transmission line and the second distributed constant line to resonate at a predetermined frequency while the second branch path is in OFF state, wherein the first distributed constant line comprises a line of field effect transistor, which determines ON or OFF state of the first distributed constant line, the second distributed constant line comprises a line of field effect transistor, which determines ON or OFF state of the second distributed constant line.

2. The switch circuit according to claim 1, wherein the ON or OFF state of the field effect transistor included in the first and second distributed constant lines are determined based on a control signal from a control unit.

3. The switch circuit according to claim 1, wherein the first and second resonant circuits use a capacitance of a field effect transistor as a capacitor.

4. The switch circuit according to claim 3, wherein ON or OFF state of the field effect transistors included in the first and second resonant circuits are determined based on a control signal from a control unit.

5. The switch circuit according to claim 1, wherein the first and second resonant circuit use a capacitance of a diode as a capacitor.

6. The switch circuit according to claim 5, wherein a bias state of the diodes included in the first and second resonant circuits is determined based on a control signal from a control unit.

7. A switch circuit, comprising:

a first branch path provided between an input terminal and a first output terminal and including a first transmission line and a first distributed constant line;

a second branch path provided between the input terminal and a second output terminal and including a second transmission line and a second distributed constant line;

a first resonant circuit connected between the first transmission line and the first distributed constant line to resonate at a predetermined frequency while the first branch path is in OFF state; and a second resonant circuit connected between the second transmission line and the second distributed constant line to resonate at a predetermined frequency while the second branch path is in OFF state, wherein the first distributed constant line comprises a line of diode, which determines ON or OFF state of the first distributed constant line, and the second distributed constant line comprises a line of diode, which determines ON or OFF state of the second distributed constant line.

8. The switch circuit according to claim 7, wherein a bias state of the diode structure included in the first and second distributed constant lines is determined based on a control signal from a control unit.

9. The switch circuit according to claim 8, wherein the first and second resonant circuits use a capacitance of a field effect transistor as a capacitor.

10. The switch circuit according to claim 9, wherein ON or OFF state of the field effect transistors included in the first and second resonant circuits are determined based on a control signal from a control unit.

11. The switch circuit according to claim 8, wherein the first and second resonant circuit use a capacitance of a diode as a capacitor.

12. The switch circuit according to claim 11, wherein a bias state of the diodes included in the first and second resonant circuits is determined based on a control signal from a control unit.

13. The switch circuit according to claim 1, wherein the first and second resonant circuits use an inductance of the transmission line as an inductor.

14. The switch circuit according to claim 1, wherein the first and second resonant circuits use an inductance of a winding as an inductor.

15. The switch circuit according to claim 1, wherein the transmission line has a length of about $\lambda/4$, provided a propagated wavelength corresponding to a predetermined operational frequency band is $\lambda$.

16. The switch circuit according to claim 7, wherein the first and second resonant circuits use an inductance of the transmission line as an inductor.

17. The switch circuit according to claim 7, wherein the first and second resonant circuits use an inductance of a winding as an inductor.

18. The switch circuit according to claim 7, wherein the transmission line has a length of about $\lambda/4$, provided a propagated wavelength corresponding to a predetermined operational frequency band is $\lambda$.

* * * * *